US009745805B2

(12) United States Patent
Evermark et al.

(10) Patent No.: US 9,745,805 B2
(45) Date of Patent: Aug. 29, 2017

(54) METHOD OF INTERCONNECTING A DRILL ROD WITH A DRILL STRING BY MEANS OF A THREADED CONNECTION, ROD HANDLING SYSTEM AND DRILL RIG

(71) Applicant: SANDVIK INTELLECTUAL PROPERTY AB, Sandviken (SE)

(72) Inventors: Kent Evermark, Karlstad (SE); Peter Rosmark, Orebro (SE); Per Vilen, Nora (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 372 days.

(21) Appl. No.: 14/430,309

(22) PCT Filed: Sep. 6, 2013

(86) PCT No.: PCT/EP2013/068485
§ 371 (c)(1),
(2) Date: Mar. 23, 2015

(87) PCT Pub. No.: WO2014/048697
PCT Pub. Date: Apr. 3, 2014

(65) Prior Publication Data

US 2015/0211310 A1 Jul. 30, 2015

(30) Foreign Application Priority Data

Sep. 26, 2012 (EP) ..... 12186110

(51) Int. Cl.
*E21B 17/042* (2006.01)
*E21B 19/16* (2006.01)
(Continued)

(52) U.S. Cl.
CPC ..... *E21B 19/16* (2013.01); *E21B 3/02* (2013.01); *E21B 17/042* (2013.01); *E21B 19/20* (2013.01); *E21B 19/24* (2013.01)

(58) Field of Classification Search
CPC ..... E21B 19/16; E21B 19/20; E21B 19/165; E21B 17/042; E21B 19/24; E21B 3/02; Y10T 29/4978
See application file for complete search history.

(56) References Cited

U.S. PATENT DOCUMENTS 4,258,796 A 3/1981 Horning et al.
4,604,724 A * 8/1986 Shaginian ..... E21B 19/20 166/53

(Continued)

FOREIGN PATENT DOCUMENTS

WO 02/079603 A1 10/2002

*Primary Examiner* — Daniel P Stephenson
(74) *Attorney, Agent, or Firm* — Corinne R. Gorski

(57) ABSTRACT

A method of interconnecting a drill rod with a drill string by a threaded connection is disclosed. The method includes axially aligning the drill rod with the drill string, rotating the drill rod in a disengagement rotational direction of the threaded connection, identifying a rotational position of the drill rod where thread ends of the rod and the drill string slip over each other, stopping the rotating within a predetermined period of identifying the rotational position, and rotating the drill rod in an engagement direction, such that the drill rod is interconnected with the drill string by the threaded connection.

17 Claims, 4 Drawing Sheets

(51) Int. Cl.

| | |
|---|---|
| ***E21B 3/02*** | (2006.01) |
| ***E21B 19/20*** | (2006.01) |
| ***E21B 19/24*** | (2006.01) |

(56) References Cited

U.S. PATENT DOCUMENTS

| | | | | |
|---|---|---|---|---|
| 4,641,410 | A * | 2/1987 | Plaquin | E21B 17/042 29/407.05 |
| 5,040,827 | A | 8/1991 | DeLange | |
| 5,321,506 | A * | 6/1994 | Sargent | H04N 7/18 29/240 |
| 5,556,253 | A * | 9/1996 | Rozendaal | E21B 19/15 198/370.01 |
| 5,661,888 | A * | 9/1997 | Hanslik | B23P 19/10 29/407.02 |
| 6,481,930 | B2 * | 11/2002 | Forrest | F16L 55/1657 173/147 |
| 6,591,471 | B1 * | 7/2003 | Hollingsworth | E21B 19/16 166/85.1 |
| 6,845,825 | B2 * | 1/2005 | Bischel | E21B 19/20 173/176 |
| 7,073,598 | B2 * | 7/2006 | Haugen | E21B 19/00 166/380 |
| 7,874,352 | B2 * | 1/2011 | Odell, II | E21B 19/06 166/75.14 |
| 8,720,541 | B2 * | 5/2014 | Ellis | E21B 19/07 166/380 |
| 9,303,472 | B2 * | 4/2016 | Ellis | E21B 19/07 |
| 2004/0223533 | A1 * | 11/2004 | Dishaw | E21B 19/165 374/4 |
| 2005/0173154 | A1 | 8/2005 | Lesko | |
| 2012/0213937 | A1 * | 8/2012 | LaValley | B26D 3/16 427/401 |
| 2012/0297933 | A1 * | 11/2012 | Lavalley | E02F 3/965 81/57.34 |
| 2015/0211310 | A1 * | 7/2015 | Evermark | E21B 19/16 166/250.01 |
| 2016/0097245 | A1 * | 4/2016 | Jelgert | E21B 7/02 166/377 |

* cited by examiner

METHOD OF INTERCONNECTING A DRILL ROD WITH A DRILL STRING BY MEANS OF A THREADED CONNECTION, ROD HANDLING SYSTEM AND DRILL RIG

RELATED APPLICATION DATA

This application is a §371 National Stage Application of PCT International Application No. PCT/EP2013/068485 filed Sep. 6, 2013 claiming priority of EP Application No. 12186110.8, filed Sep. 26, 2012.

TECHNICAL FIELD

The present disclosure relates to a method of interconnecting rods to form part of a drill string, and more particularly to a method of detecting a thread entrance of a drill string rod. The disclosure also relates to a device for such thread detection and to a ground drill system comprising such a device.

BACKGROUND

In exploration drilling, the average length of a drill string may typically be about 900 m. The drill string is typically composed of a plurality of drill rods, which, depending on configuration, typically weigh about 11-20 kg each and measure about 2-3 m in length. The drill rods are interconnected by a threaded connection.

Moreover, in many applications, also depending on rock type, tool type and drilling speed, it may be necessary to exchange the drill bit or other tool parts, e.g. every 300 m of drilling. Changing tools may be associated with retrieving the entire drill string from the hole, changing the lowermost portion and then reinserting the entire drill string, after which drilling may continue. In practice, and depending on rock conditions, 10-20 retrieval operations per drill hole is not uncommon.

Needless to say, a very large number of drill rods will need to be handled, including picking them from a transport carrier, inserting them into the drill, fastening them, releasing them and replacing them at the transport carrier.

In reality, this may mean that an operator has to carry/lift an 11 to 20 kg rod, about 1200 times to or from the rig for each hole. The estimated average number of holes drilled by one rig is 35 holes/year, resulting in that the operator carries (11 to 20)*1200*35/(220 working days)=2100 to 3820 kg/day. This is the main reason for developing a so-called Rod Handling System (RHS).

Such Rod Handling Systems are disclosed in WO2011/129760A1 and WO 00/65193A1. A Rod Handling System may typically comprise a robot arm having a dedicated gripper for gripping the drill rods. During a forward drilling operation, the robot arm is arranged to pick up drill rods at a transport or intermediate carrier and to place the drill rod in the drill unit, whereupon the drill rod is connected to an already installed drill rod to extend the drill string. During a drill string retrieval operation, the robot arm is arranged to pick up disconnected rods from the drill unit and to replace them onto the transport or intermediate carrier.

In order to provide a fully automatic system, thereby further eliminating manual work, it is desirable for the Rod Handling System to be able to connect and disconnect the drill rod to/from the installed drill rods.

However, the threads used in many drilling applications, including wire-line core drilling, may have a very low thread height, and they may be slightly conical.

If a pair of such threads is brought axially together at random, experience shows that there is about 60% chance of the threads not engaging each other, or engaging each other incorrectly. In either case, the threads may become damaged, resulting in additional cost and work.

WO 02/079603A1 discloses a system for automatically connecting drill rods to form a drill string. In this system, marks are provided around the perimeter of the rods, such that their rotational positions can be determined, thus allowing the rods to be rotationally aligned for optimal thread entry.

There is a need for an improved way of automatically and safely finding the thread entrance when using a Rod Handling System for connecting drill rods.

SUMMARY

It is an object of the present disclosure to provide an improved method and device for thread detection and drill rod interconnection.

The invention is defined by the appended independent claims. Embodiments are set forth in the dependent claims, in the following description and on the attached drawings.

According to a first aspect, there is provided a method of interconnecting a drill rod with a drill string by means of a threaded connection. The method comprises axially aligning the drill rod with the drill string, rotating the drill rod and the drill string relative each other in a disengagement rotational direction of the threaded connection, identifying a rotational position of the drill rod where thread ends of the drill rod and the drill string slip over each other, stopping said rotating within a predetermined period of identifying the rotational position, and rotating the drill rod and the drill string relative each other in an engagement direction, such that the drill rod is interconnected with the drill string by the threaded connection.

The aligning step should be understood as providing a sufficient alignment for the threads to be interconnectable. Hence, minor radial and/or angular deviations may be tolerated.

The "predetermined period" may be a time period, rotation angle and/or axial displacement. The rotating of the drill rod and the drill string is normally a rotation of the drill rod relative to a stationary drill string, but rotation of the drill string (alone or as a complement) is not excluded.

Typically, the drill string remains substantially stationary, while the drill rod is being rotated.

Tests have shown that the use of this method results in a clear improvement in the success rate when interconnecting drill rods using an automated RHS.

The method may further comprise axially biasing the drill rod and the drill string towards each other. This biasing may be in the form of biasing the drill rod towards the drill string. Such biasing may be achieved by means of a biasing element (such as a resilient element), an actuator or by means of gravity, e.g. using the weight of the drill rod itself.

The method may further comprise recording an axial displacement of the rod during said rotating, and identifying a rotational position based on the axial displacement.

The identification of the directional shift of the axial movement has proven to be an accurate way of identifying the rotational position.

The identification of the rotational position of the drill rod may comprise detecting a shift from a movement of the drill rod away from the drill string to a movement of the drill rod towards the drill string.

The method may further comprise detecting an increase and/or decrease in a ratio between axial and rotational movement.

The step of identifying a rotational position of the drill rod may further comprise a subsequent detecting of a second shift from the movement of the rod towards the drill string to a movement of the drill rod away from the drill string.

Alternatively, or as a complement, the step of identifying a rotational position of the drill rod may comprise detecting an axial acceleration.

Alternatively, or as a complement, the step of identifying a rotational position of the rod may comprise detecting a pressure drop in a fluid used for biasing and/or feeding the drill rod and/or the drill string towards each other According to a second aspect, there is provided a rod handling system, adapted for supplying a drill rod that is to be connected to a drill string. The system comprises a moveable arm having gripping means adapted for gripping the drill rod, means for rotating the drill rod and the drill string relative each other about a longitudinal axis thereof and in a disengagement direction of the threaded connection, and means for detecting a rotational position of the drill rod where thread ends of the drill rod and of the drill string slip over each other.

The system may further comprise means for biasing the drill rod and the drill string towards each other.

The gripping means may comprise at least one rotatable member having a perimeter which is adapted for frictionally engaging an outer wall of the drill rod.

The rotatable member may be axially slidable in a direction substantially parallel with the longitudinal axis.

The system may further comprise a drive arrangement, adapted for causing the rotatable member to rotate.

The rotatable member may be biased in a direction substantially towards the drill string.

The system may further comprise a jaw, which carries the rotatable member, such that the rotatable member is slidable relative to the jaw, wherein the jaw is displaceable in the direction substantially parallel with the longitudinal axis.

The above-mentioned means for detecting a rotational position may be arranged to record a longitudinal position or change in position of the drill rod along the longitudinal axis and to derive said rotational position of the drill rod based on said longitudinal position or change in position.

According to a third aspect, there is provided a drill rig assembly, comprising a feed device, a drilling device, which is movable along the feed device to and from a drill string, and a rod handling system as described above, wherein the rod handling system is arranged to pick up and/or drop off drill rods from/onto a carrier and to move the drill rods to/from the feed device. Such a carrier may, as non-limiting examples, be a storage device, a rod feed device or a drill rod cassette.

DESCRIPTION OF EMBODIMENTS

Figure 1:
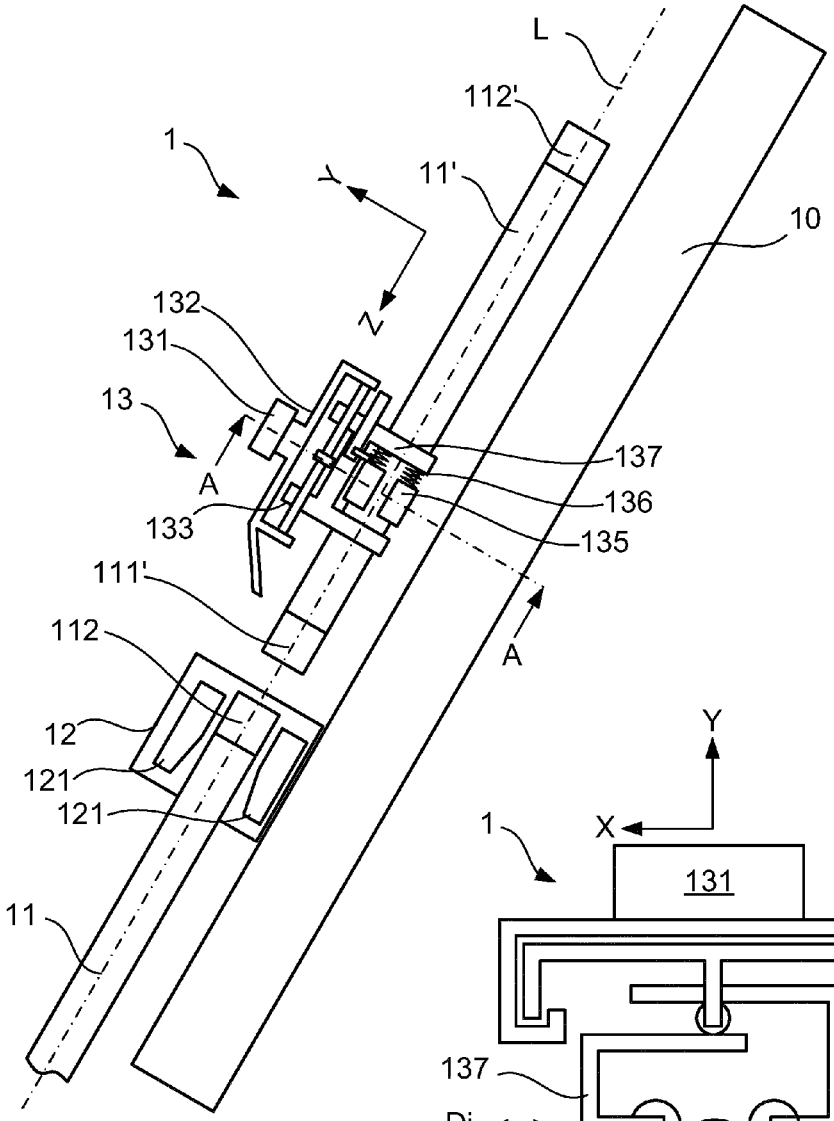
FIG. 1 is a schematic side view of a drill unit provided with a rod handling system.

FIG. 1 schematically illustrates a drill rig, comprising a frame 10, which may be arranged so as to point with its longitudinal direction substantially in a drilling direction and an RHS 1. The frame 10 may carry a feed device (not shown), which may include a pair of sprockets over which a chain runs. The feed device is arranged to allow displacement of a drilling device 12 along the frame 10, e.g. as is known from WO 96/30627. The drilling device 12 may comprise a rotation motor, optionally a gear box, and a chuck comprising chuck grippers 121, which may be radially moveable in a per se known manner. The drilling unit may have a through passage, which allows components 11, 11' forming the drill string to pass through it. The components may be drill rods 11, 11'.

Such drill rods may include, or consist of; end pieces carrying drill bits, a DTH hammer unit, a damper unit, and/or a plurality of intermediate drill rods. Each drill rod 11, 11' may comprise an elongate, substantially cylindrical body, which may be tubular (and thus hollow), a respective male thread 11' at one end thereof and a respective female thread 112, 112' at the other end thereof.

Figure 2:
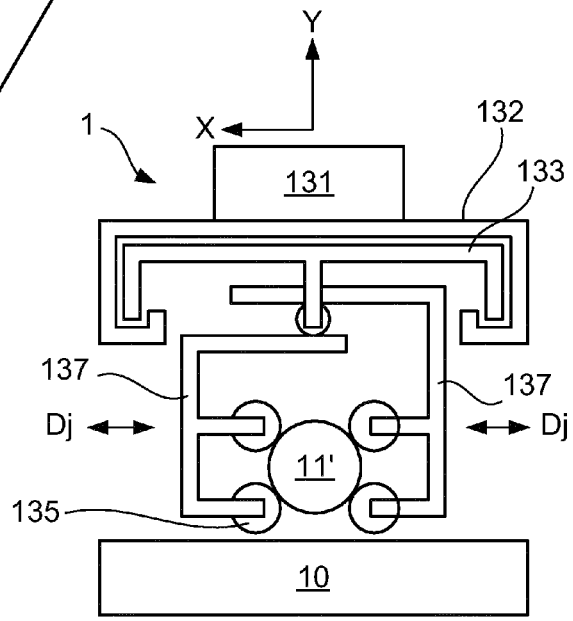
FIG. 2 is a schematic sectional view of the drill unit of FIG. 1.
Figure 3:
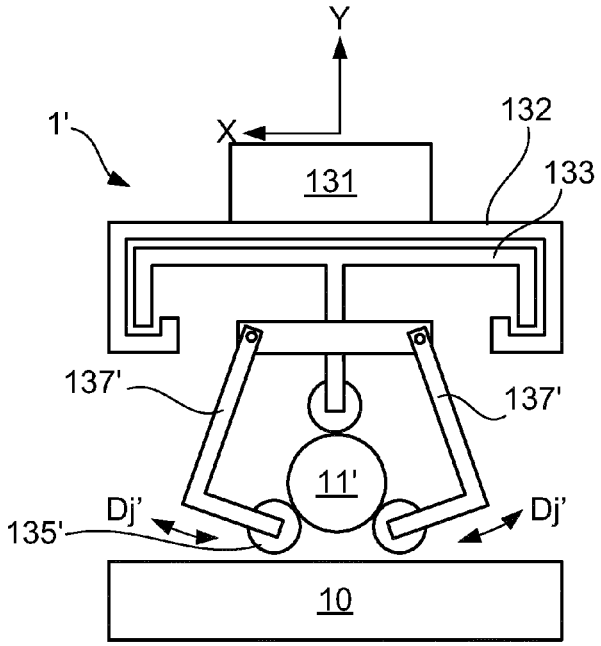
FIG. 3 is a schematic sectional view of an alternative rod handler unit design.

In typical applications, the drill rods may have an outer diameter in the area of 40-200 mm and most commonly in the area of 40-120 mm. Thread sections may be conical with an angle of about 0.5°-1.5°, most commonly about 1°. Thread depth may be in the area of 0.5-2 mm, most commonly 0.5-1.5 mm. Thread pitch may be in the area of 2-5 threads/inch. In FIGS. 1-3, directions are defined as follows: the Z direction is the drilling direction. +Z thus illustrates forward drilling and −Z illustrates reverse drilling (retrieval of drill string). Y is perpendicular to the Z direction and Y and Z form a plane, in which a central axis L of the drill string is positioned. X is perpendicular to both Y and Z.

The basic operation of the drill rig is known, per se, from e.g. WO96/30627 and WO2011/129760A1.

FIGS. 1 and 2 further illustrates a rod handler 13, comprising an arm 131, a gripper cradle 132, a gripper frame 133, gripper jaws 137, gripper rollers 135 and biasing springs 136.

The arm 131 of the rod handler 13 may be movable between a first position (not shown), where the rod handler 13 is able to pick up a drill rod from a rod carrier (not shown) and a second position (FIG. 1), where it is able to position the drill rod in the drill rig (as illustrated in FIG. 1).

The gripper frame 133 may be movable relative to the gripper arm 131 in a direction substantially parallel with the drilling direction Z. This may be achieved by arranging the gripper frame 133 in a gripper cradle 132 and by providing an actuator (not shown) for controlling the relative motion between the gripper frame 133 and the gripper cradle 132. It is possible to use any type of actuator providing a substantially linear motion.

In order to allow for gripping (or dropping off) a drill rod 11', the jaws 137 of the rod handler 13 may be movable relative to the gripper frame in the direction Dj, parallel to the X direction, as illustrated in FIG. 2. This may be achieved by providing an actuator providing a substantially linear motion in the Dj direction.

The gripping rollers 135 may be slidingly moveable relative to the gripper jaws 137 substantially parallel with the drilling direction Z. For example, each gripper roller may be arranged on a shaft extending in, or parallel to, the Z direction. A biasing device 136 may be provided for biasing the gripper roller 135 forwardly in the drilling direction +Z. The biasing device 136 may be a helical spring, a gas spring or any other type of resilient element. The rollers 135 may be slidingly movable under the influence of the biasing device a distance corresponding to at least about 1-2 times the thread pitch of the thread system 112, 112', 111' used for interconnecting the drill rods.

In the illustrated embodiment, there are four sets of gripping rollers 137. Each set may comprise a plurality of rollers which are aligned along an axis which is parallel with the drilling direction Z. The sets of gripping rollers may be arranged to define a rectangular cross section with one set of gripping rollers at each corner and with the central axis of the drill string coinciding with the intersection of the diagonals of the rectangle.

The one or more of the gripping rollers 135 may also be drivably rotatable about their respective shaft. Hence, a roller actuator may be connected to at least one of the gripping rollers, alternatively to an entire set of gripping rollers, to more than one set of gripping rollers or to all sets of gripping rollers. Those gripping rollers which (if any) are not connected to the roller actuator may be freely rotatable about their respective axis.

FIG. 3 illustrates an alternative embodiment of the gripper, wherein there are only three sets of gripping rollers 135', arranged to define a triangular cross section with one set of rollers at each corner. In this case, the jaws 137' may be pivotable in a respective direction Dj'.

The operation of the rod handler 13 will now be described with reference to FIGS. 1, 2 and 4. It is noted that the embodiment disclosed in FIG. 3 will be operable in substantially the same manner.

In order to connect a new drill rod 11' to an already installed drill rod 11 (or a drill string formed of a plurality of installed drill rods), the arm 131 is operable to move the gripper close enough to a drill rod carrier such that a drill rod may be picked up from the carrier and held by the jaws 137 such that the gripping rollers 135 contact the outer surface of the drill rod 11'.

The arm 131 then moves the drill rod 11' towards the drill rig to a position where male thread 111' of the new drill rod 11' is aligned with the female thread 112 of the already installed drill rod 11. In this position, longitudinal central axes L of the installed drill rod 11 and the new drill rod 11' may be substantially aligned with each other. Minor deviations may be tolerable. At this position, the thread portions may be on the order of 100-300 mm apart.

The gripper frame 133 is then caused to move relative to the gripper cradle 132 such that the gripper 133 frame is moved in the +Z direction, thus causing the new drill rod 11' to move in the +Z direction towards the installed drill rod 11. The gripper frame 133 may be moved to such an extent that the end portion of the new drill rod 11' with the male thread 111' contacts the end portion of the installed drill rod 11 with the female thread 112 and causes the gripping rollers 135 to be displaced in the −Z direction relative to the gripper frame 133. Through this displacement, the biasing device 136 may become activated (e.g. by being compressed) so as to provide a biasing force between the thread portions 112, 111'. This biasing displacement may be measured in order to secure an adequate biasing force.

While the thread portions 112, 111' are biased towards each other, the gripping rollers 135 may be caused to rotate so as to cause the new drill rod 11' (but not the installed drill rod 11) to rotate about its longitudinal axis in a reverse direction, i.e. a direction in which the new rod 11' would be rotated when disconnecting it from the installed rod 11 (typically counter clockwise).

During this reverse rotating motion, the new rod 11' will move along its longitudinal direction due to the cam effect of the abutting thread ends.

A measuring device may be provided for measuring the movement of the new drill rod 11' while rotated. Such a device may detect the longitudinal relative movement of a point on the new drill rod 11' or on a part connected to the new drill rod 11'; a point on a roller 135 or on a part connected to a roller 135; or a point on the gripper frame 133 or on a part connected to the gripper frame 133.

Figure 4:
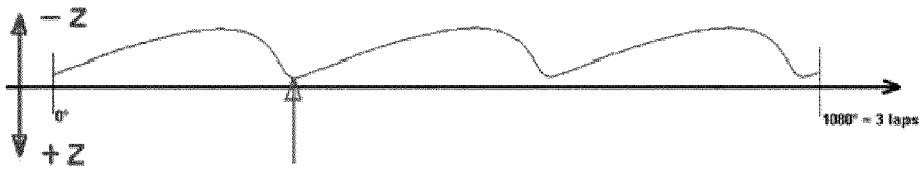
FIG. 4 is a diagram showing axial position of the drill rod as a function of rotational position.

FIG. 4 illustrates data generated by measurement of the longitudinal movement of the new rod 11' as a function of rotational position over three full laps. The graph presents maxima at the points where the outermost parts of the thread ridges contact each other and minima at the points where the threads have slipped over each other and thus cause the new rod 11' to move forwardly. Hence, from the graph, it is possible to identify a relative position between the threads where they have a good likelihood of engaging properly. In practice, the new rod 11' may be rotated reversely and the rotation stopped at a point (or predetermined period) just after a minimum has been identified, i.e. where a change in direction of movement from +Z to −Z has been detected. If no such point is identified within 1-3 laps, the thread detection may be interrupted and an alarm triggered, such that an operator may take over.

Once the thread entrance has been identified, the new drill rod 11' may be caused to rotate in the forward direction (typically clockwise) so as to allow the threads 112, 111' to engage. This forward rotation may continue for a predefined rotation time, to a predefined length position, or until a predefined force or torque is achieved (e.g. causing drive rollers to slip).

It is possible to allow the gripping rollers 135 to move under the influence of the biasing device to such an extent as to correspond to at least the entire length of the thread portion 112, 111'. Hence, the longitudinal movement of the new rod 11' when rotating it forwardly until firmly engaged with the installed rod 11 will be compensated for by the longitudinal movement of the gripping rollers. As an alternative, or complement, the gripper frame 133 may be caused to move, or merely released and allowed to move freely relative to the gripper cradle 132, so as to provide such compensation.

Figure 5:
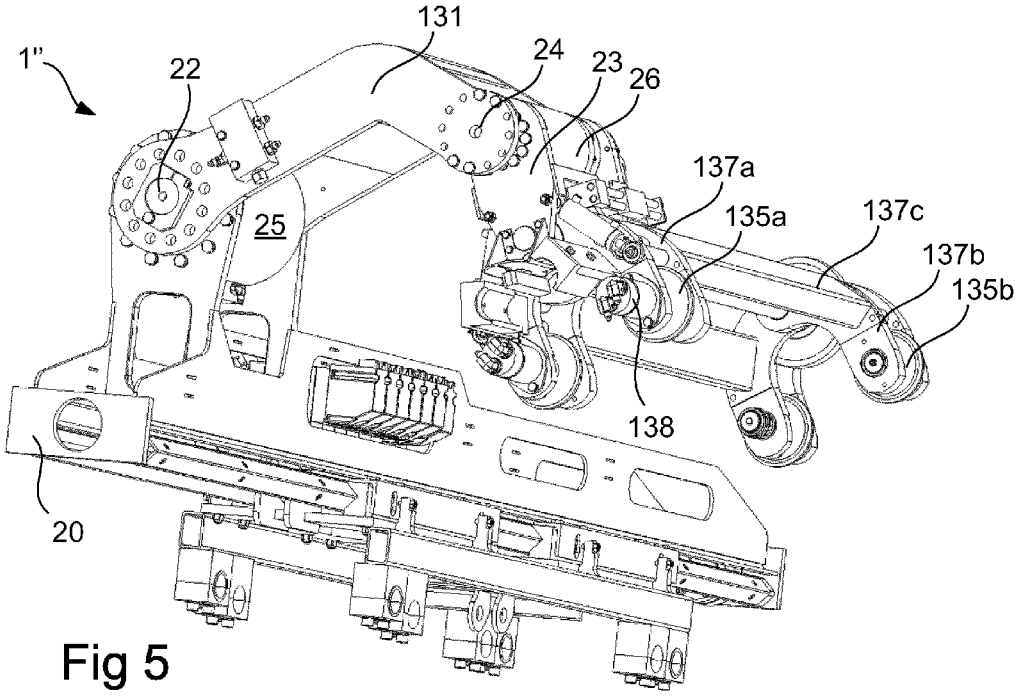
FIG. 5 is a schematic perspective view of a rod handling device.
Figure 6:
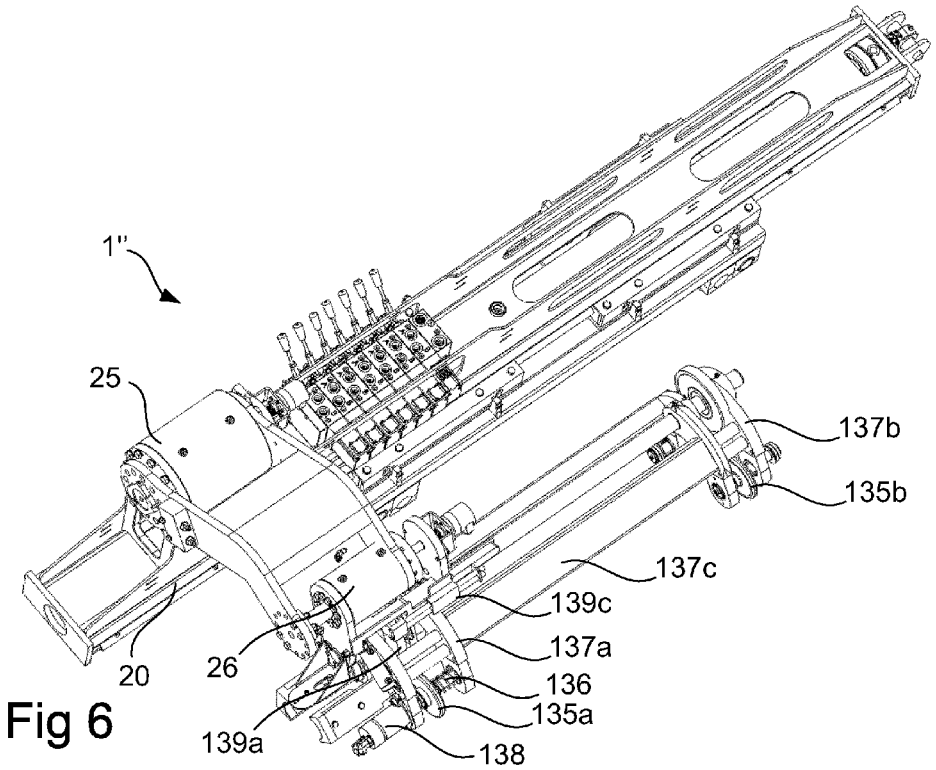
FIG. 6 is a schematic perspective view of the rod handling device of FIG. 5.
Figure 7:
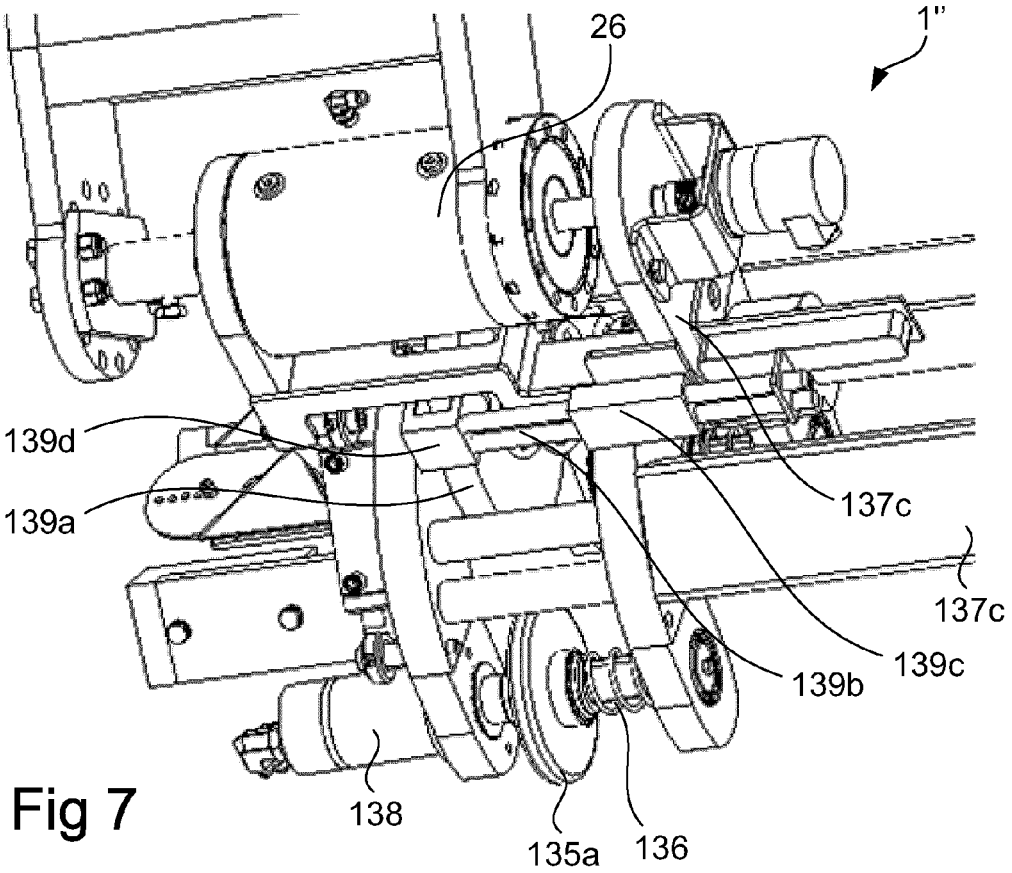
FIG. 7 is an enlarged detail of a part of the rod handling device of FIGS. 5 and 6.

FIGS. 5-7 disclose an embodiment of a rod handler 1" which may be used for implementing the present invention.

The rod handler 1" may include a handler base frame 20 which may be integrated with a drill rig frame or which may form a separate frame, which may be fitted or retrofitted to a drill rig frame. As another alternative, the rod hander may form a separate unit, which may be positioned in the immediate vicinity of the drill rig.

The rod handler 1" may further include an arm 131 which is connected to the base by a first joint 22 and to a free head portion 23 by a second joint 24. Hydraulic, pneumatic or electric actuators 25, 26 may be provided for causing motions at the joints 22, 24.

The head portion 23 may include the parts disclosed above with reference to FIGS. 1-3. For example, a set of longitudinally spaced apart gripping jaws 137*a*, 137*b* may be provided, connected by a jaw spacer 137*c*, such that the gripping rollers 135*a*, 135*b* are spaced apart along the drill rod longitudinal direction so as to reduce torques at the gripping rollers 135*a*, 135*b*.

The illustrated embodiment comprises three sets of gripping rollers 135*a*, 135*b*, with each set comprising two longitudinally spaced apart gripping rollers 135*a*, 135*b*. Each set of gripping rollers may comprise one driven roller 135*a* and one freely rotatable support roller 135*b*.

In the disclosed embodiment, each roller 135*a*, 135*b* is arranged on its own shaft and not mechanically connected to any other of the rollers.

The biasing devices 136 are provided in the form of helical springs, arranged to act upon the respective driven roller 135*a*.

Roller actuators 138 are provided for driving the respective rollers.

The rollers 135, 135*a*, 135*b* may have the same or different surface properties at the drill rod supporting surface. In one embodiment, the rollers are provided with a rubber or rubber-like material in order to increase their coefficient of friction relative to the drill rod. Alternatively, or as a complement, the supporting surface may be patterned for providing increased coefficient of friction.

The rollers may be designed with rounded edges between their respective radially and axially facing surfaces, such that relative movement between rollers and drill rod is facilitated. Such rounded edges may have a radius of curvature in the Y-Z plane of at least 0.5 mm, 1 mm, 2 mm or 5 mm.

In embodiments where all rollers have a supporting surface providing sufficient friction, it may be advantageous to design all rollers such that they are displaceable in the Z directions and subject to a bias in the +Z direction.

In an alternative embodiment, support rollers 135*b* may have a lower surface friction than driven rollers 135*a*, in which case it may not be necessary, albeit possible, to make the support rollers 135*b* displaceable in the Z direction.

One or more of the rollers 135 may, as a complement, or instead of being driven, be dedicated as a measuring roller 139*a*. Such a measuring roller 139*a* may be designed to be moveable with the drill rod 11' and to provide as little resistance as possible. The measuring roller 139*a* may be connected by a roller follower 139*d* to a measuring sensor 139*c* by a rigid rod 139*b*, such that an axial movement of the drill rod 11' results in a corresponding axial movement of the measuring roller 139*a*. The measuring sensor 139*c* may be fixedly connected to the jaw frame 133. The movement may be recorded by the measuring sensor via the measuring rod 139*b*, which may be axially fixed in relation to one of the measuring roller 139*a* and the measuring sensor 139*c* and movable relative to the other of the measuring roller 139*a* and the measuring sensor 139*c*. This measuring device 139*a*, 139*b*, 139*c*, 139*d* may also be used for measuring the length displacement when applying the biasing force and/or during the forward rotation for engaging the threads.

It is noted that alternative methods of recording the axial movement of the measuring roller and/or of the drill rod 11' may be applied. Such alternative methods include optical methods (e.g. laser ranging, and camera based methods).

It is also possible to use hydraulic or pneumatic means for biasing the rollers in the +Z direction. In such case, a pressure change in the pressure medium (gas or liquid) may be used as an indication of the axial movement.

Another option is to arrange the biasing device to act between the gripper frame 133 and the gripper cradle 132, in which case the biasing devices at the rollers may be dispensed with. Hence the gripper frame may be biased in the forward direction +Z.

Yet another option is to use an accelerometer to measure the acceleration of the new drill rod 11' achieved when the thread ends slip over each other, and to use this acceleration as an indication of the rotational position.

Another option is to use a sound sensor, which records the sound produced when the thread ends slip over each other and the threads strike against each other at the end of the forward +Z motion.

In an alternative method for detecting the thread entrance, the new drill rod 11' may be aligned with the drill string 11, after which an immediate attempt to engage the threaded portions by rotation in the engagement direction is made. During this engagement attempt, the force or torque needed for achieving the engagement may be measured, e.g. by measuring the current drawn by the actuator used to provide the rotational movement or by measuring the actual longitudinal movement and to compare this with the expected longitudinal movement, whereby a deviation may indicate that the drive rollers are slipping against the surface of the new rod 11'. Hence, failure (jamming) of the thread connection may be detected. When such failure is detected a backward rotation may be performed. When the threaded connection is released, there may be a significant decrease in the force or torque or, if there is a biasing in the reverse direction −Z, a sudden axial movement in the −Z direction may be detected.

When such release is detected, this may be used as an indication of the rotational position of the thread ends, analoguous with what was described with respect to the previous set of embodiments, and thus as an indication of where to restart the forward +Z rotation.

While the embodiments above make use of axially movable and biased rollers, it is possible to provide the biasing of the threaded portions in other ways. For example, the rollers may have a tiltable axis of rotation, which may be angled relative to the longitudinal direction of the drill rod, such that the rotation of the rollers may cause both reverse rotational and axial movement of the drill rod in the +Z direction.

It is also noted that the rod handler may be provided with an application specific arm, as disclosed herein, or be based on a general industrial robot having a modified free end.

It is noted that the actuators and sensors described above may be connected to a control system adapted for receiving sensor inputs, processing sensor inputs and providing control signals to actuators. Such control systems are deemed to be known as such and need no further description.

In addition to exploration drilling, this invention can be usefull also in connection any other rotary type drilling like for example blast hole drilling.

The invention claimed is:

1. A method of interconnecting a drill rod with a drill string by a threaded connection, the method comprising:

axially aligning the drill rod with the drill string;

rotating the drill rod and the drill string relative each other in a disengagement rotational direction of the threaded connection;

identifying a rotational position of the drill rod where thread ends of the rod and the drill string slip over each other;

stopping said rotating within a predetermined period of identifying the rotational position; and rotating the drill rod and the drill string relative to each other in an engagement direction, such that the drill rod is interconnected with the drill string by the threaded connection.

2. The method as claimed in claim 1, further comprising axially biasing the drill rod and the drill string towards each other.

3. The method as claimed in claim 1, further comprising during said rotating, recording an axial displacement of the drill rod, and identifying a rotational position of the drill rod based on the axial displacement.

4. The method as claimed in claim 3, wherein said identifying a rotational position of the drill rod comprises detecting a shift from a movement of the drill rod away from the drill string to a movement of the rod towards the drill string.

5. The method as claimed in claim 4, further comprising detecting an increase and/or decrease in a ratio between axial and rotational movement.

6. The method as claimed in claim 3, wherein said identifying a rotational position of the drill rod further comprises a subsequent detecting of a second shift from the movement of the drill rod towards the drill string to a movement of the drill rod away from the drill string.

7. The method as claimed in claim 1, wherein said identifying a rotational position of the drill rod comprises detecting an axial acceleration.

8. The method as claimed in claim 1, wherein said identifying a rotational position of the drill rod comprises detecting a pressure drop in a fluid used for biasing and/or feeding the drill rod and/or the drill string towards each other.

9. A rod handling system for supplying a drill rod that is to be connected to a drill string, the system comprising:

a moveable arm having gripping jaws arranged for gripping the drill rod;

at least one rotatable member arranged to rotate the drill rod and the drill string relative each other about a longitudinal axis thereof and in a disengagement direction of the threaded connection; and at least one measuring roller arranged to detect a rotational position of the drill rod where thread ends of the drill rod and of the drill string slip over each other.

10. The system as claimed in claim 9, further comprising a biasing device for biasing the drill rod towards the drill string.

11. The system as claimed in claim 10, wherein the at least one rotatable member is biased in a direction substantially towards the drill string.

12. The system as claimed in claim 10, wherein the at least one measuring roller for detecting a rotational position is arranged to record a longitudinal position or change in position of the drill rod along the longitudinal axis and to derive said rotational position of the drill rod based on said longitudinal position or change in position.

13. The system as claimed in claim 9, wherein the at least one rotatable member has a perimeter arranged for frictionally engaging an outer wall of the drill rod.

14. The system as claimed in claim 13, wherein the at least one rotatable member is axially slidable in a direction substantially parallel with the longitudinal axis.

15. The system as claimed in claim 14, further comprising a jaw, which carries the at least one rotatable member, such that the at least one rotatable member is slidable relative to the jaw, wherein the jaw is displaceable in the direction substantially parallel with the longitudinal axis.

16. The system as claimed in claim 13, further comprising a drive arrangement arranged for causing the at least one rotatable member to rotate.

17. A drill rig assembly comprising:

a feed device;

a drilling device, which is movable along the feed device to and from a drill string; and a rod handling system, wherein the rod handling system is arranged to pick up and/or drop off drill rods from/onto a carrier and to move the drill rods to/from the feed device, the rod handling system including a moveable arm having gripping jaws arranged for gripping the drill rod, at least one rotatable member arranged to rotate the drill rod and the drill string relative each other about a longitudinal axis thereof and in a disengagement direction of the threaded connection, and at least one measuring roller arranged to detect a rotational position of the drill rod where thread ends of the drill rod and of the drill string slip over each other.

* * * * *